US010849370B2

(12) United States Patent
Morgan

(10) Patent No.: US 10,849,370 B2
(45) **Date of Patent: *Dec. 1, 2020**

(54) FLY SHIELD FOR GARMENT SUCH AS PAIR OF JEANS

(71) Applicant: PREMIER BRANDS IP LLC, New York, NY (US)

(72) Inventor: Gareth Morgan, Hong Kong (HK)

(73) Assignee: PREMIER BRANDS IP LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/368,364

(22) Filed: Mar. 28, 2019

(65) Prior Publication Data

US 2019/0335823 A1 Nov. 7, 2019

Related U.S. Application Data

(63) Continuation of application No. 15/969,979, filed on May 3, 2018, now Pat. No. 10,251,431.

(51) Int. Cl.

| | |
|---|---|
| ***A41D 1/06*** | (2006.01) |
| ***A41H 37/00*** | (2006.01) |
| ***A41D 27/20*** | (2006.01) |
| ***A41B 9/02*** | (2006.01) |

(52) U.S. Cl.

CPC ..... *A41D 1/06* (2013.01); *A41B 9/02* (2013.01); *A41D 1/065* (2013.01); *A41D 27/202* (2013.01); *A41H 37/003* (2013.01); *A41D 2300/322* (2013.01)

(58) Field of Classification Search

CPC ..... A41D 1/06; A41D 1/065; A41D 27/202; A41B 9/02; A41H 37/003

See application file for complete search history.

(56) References Cited

U.S. PATENT DOCUMENTS

| | | | | |
|---|---|---|---|---|
| 1,173,943 | A | 2/1916 | Flenniken | |
| 2,136,702 | A | 11/1938 | Markin | |
| 2,607,922 | A | 8/1952 | Stein | |
| 10,251,431 | B1 * | 4/2019 | Morgan | A41D 1/065 |
| 2003/0024134 | A1 | 2/2003 | Howlett | |
| 2008/0040837 | A1 | 2/2008 | King | |
| 2013/0298311 | A1 * | 11/2013 | Gerenda | A41D 1/06 2/235 |

OTHER PUBLICATIONS

International Search Report and Written Opinion issued by the US International Search Authority regarding International Application No. PCT/US2019/030115, dated Jun. 20, 2019, 17 pages.

(Continued)

*Primary Examiner* — Tajash D Patel

(74) *Attorney, Agent, or Firm* — Haynes and Boone, LLP

(57) ABSTRACT

A fly shield for a garment such as, for example, a pair of jeans. The fly shield is coupled to a waistband of the garment and extends along a zipper and over a crotch seam of the garment. The portion of the fly shield that extends over the crotch seam of the garment has less than four layers of material and/or consists of a first material layer and a second material layer.

20 Claims, 13 Drawing Sheets

(56) References Cited

OTHER PUBLICATIONS

Heather Lou, "How to Sew a Fly Front Zipper," Nov. 19, 2014, pp. 16-37, accessible https://closetcasepatterns.com/ginger-sewalong-pt-8-sewing-a-fly-front-zipper/ (accessed on Feb. 15, 2018) (22 pages).
Office Action dated Aug. 9, 2018 issued in U.S. Appl. No. 15/969,979, 6 pages.
Notice of Allowance dated Nov. 27, 2018 issued in U.S. Appl. No. 15/969,979, 5 pages.

* cited by examiner

FLY SHIELD FOR GARMENT SUCH AS PAIR OF JEANS

CROSS-REFERENCE TO RELATED APPLICATION

This application is a continuation of U.S. application Ser. No. 15/969,979, filed May 3, 2018, the entire disclosure of which is hereby incorporated herein by reference.

BACKGROUND

The present disclosure relates in general to a fly shield for a garment such as, for example, a pair of jeans.

DETAILED DESCRIPTION

Figure 1:
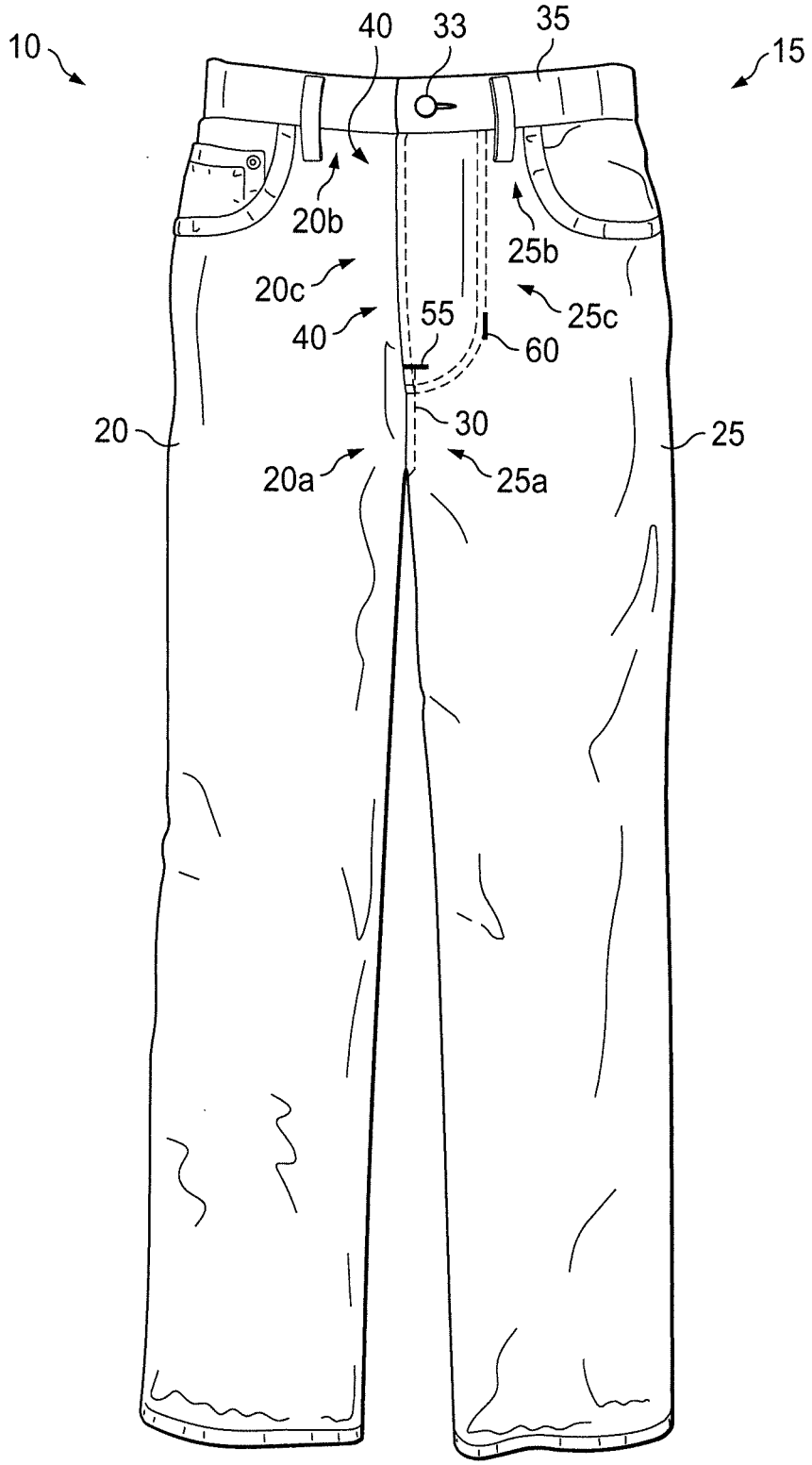
Fig. 1 (PRIOR ART)
FIG. 1 is a front view of a front portion of a conventional garment.
Figure 2:
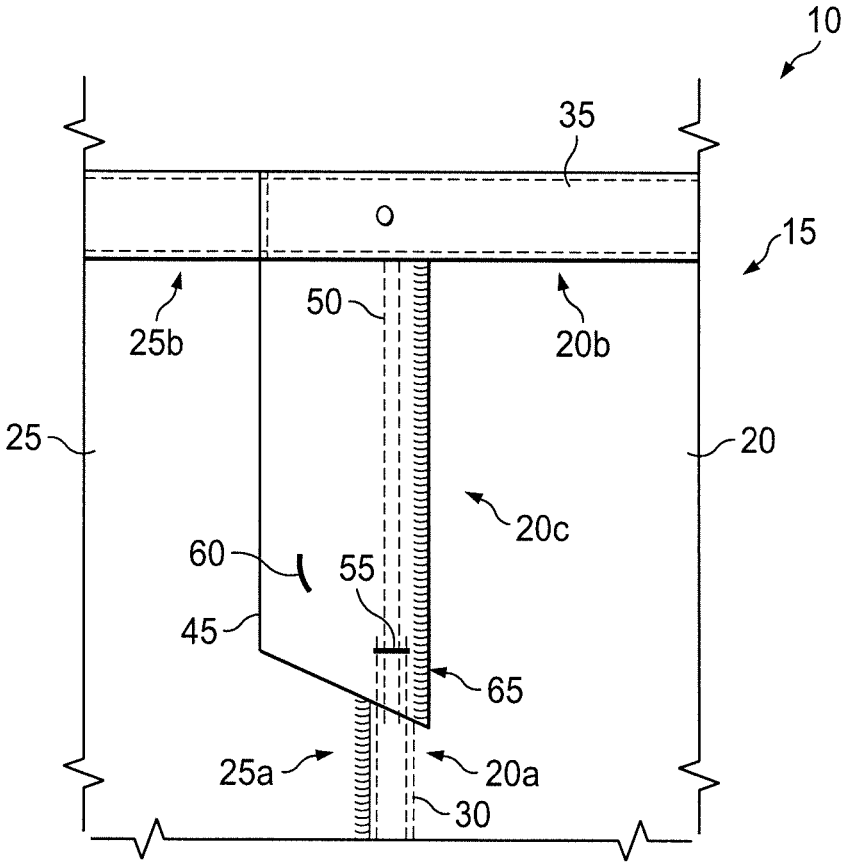
Fig. 2 (PRIOR ART)
FIG. 2 is a back view of the front portion, including a conventional fly shield, of the garment of FIG. 1.
Figure 3:
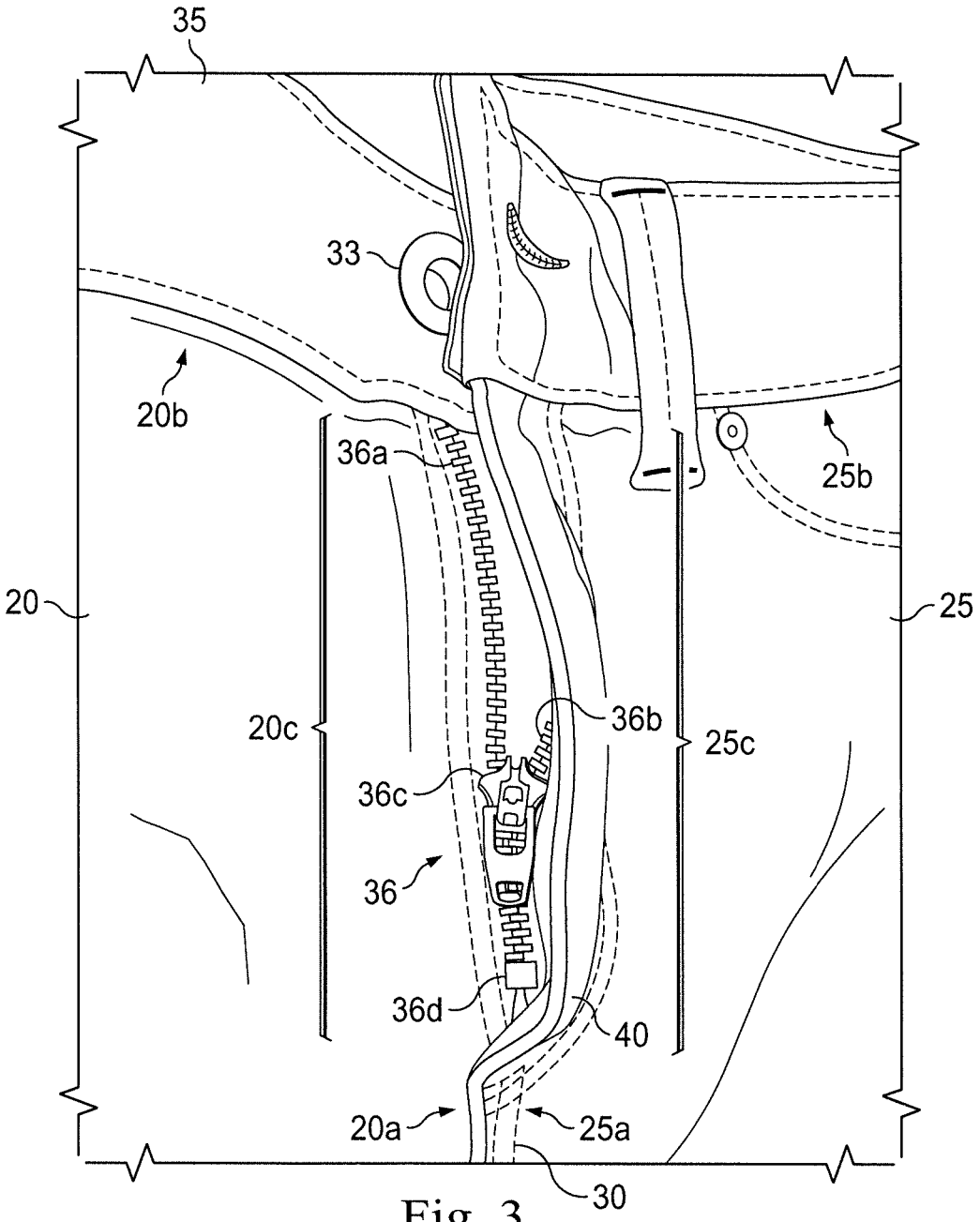
Fig. 3 (PRIOR ART)
FIG. 3 is a perspective view of the front portion of the garment of FIG. 1.
Figure 4:
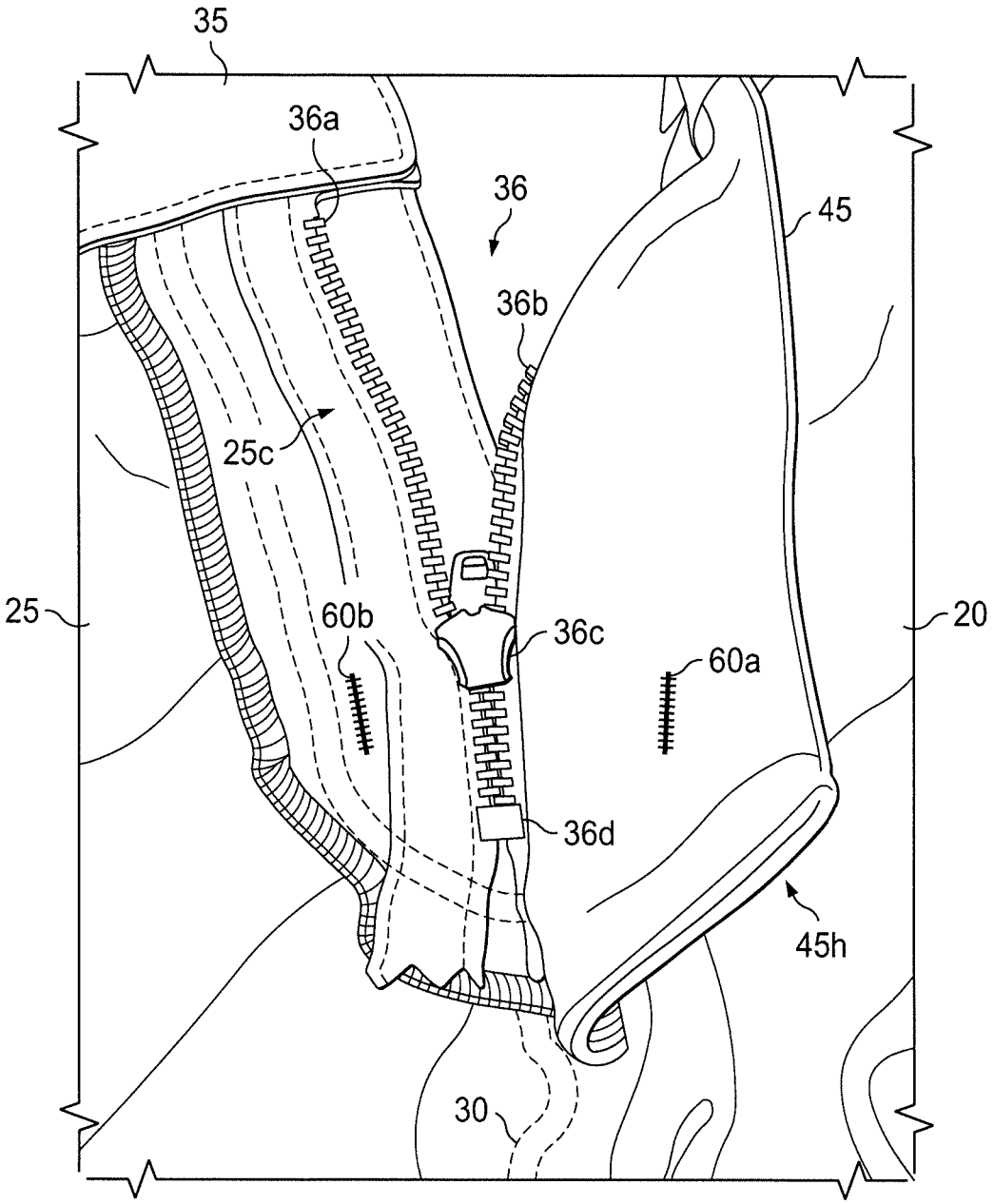
Fig. 4 (PRIOR ART)
FIG. 4 is another perspective view of the front portion, including the conventional fly shield, of FIG. 2.
Figure 5:
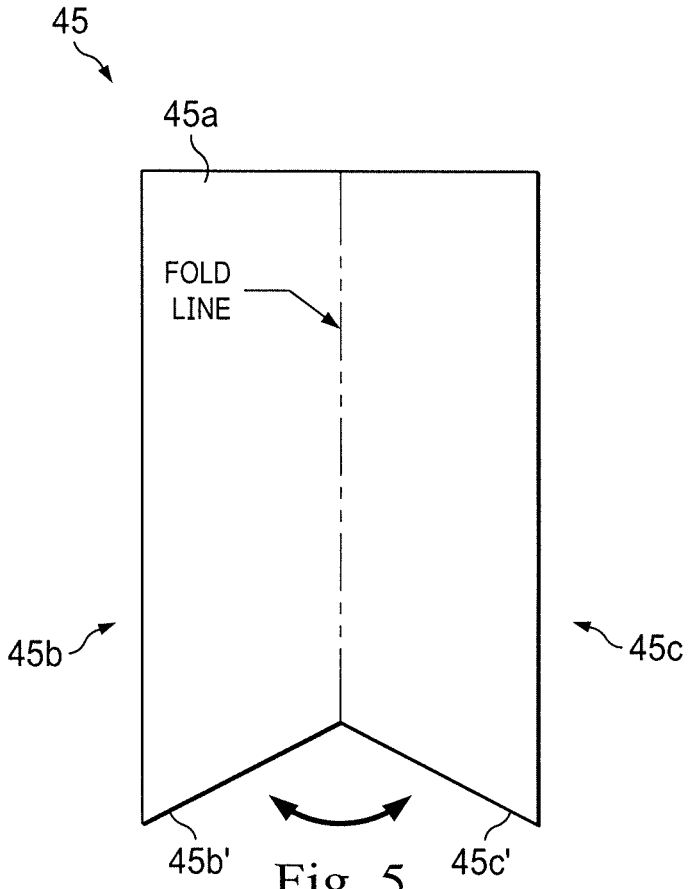
Fig. 5 (PRIOR ART)
FIG. 5 is a top view of the conventional fly shield of FIG. 2 during a step of constructing the conventional fly shield.
Figure 6:
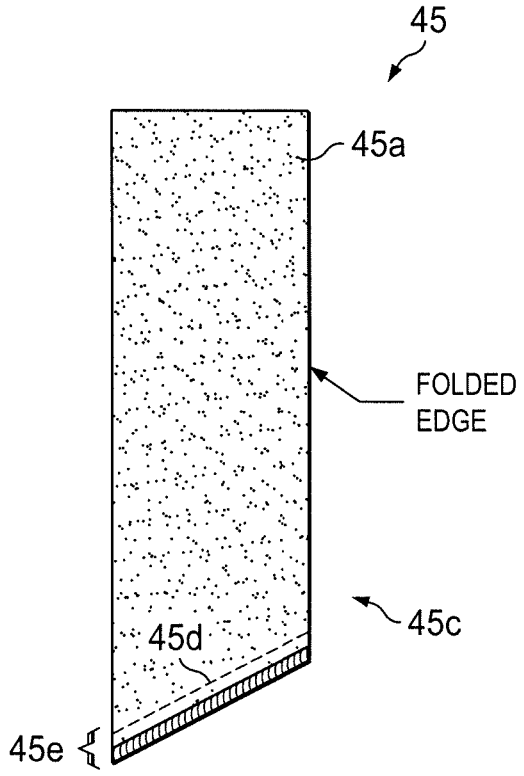
Fig. 6 (PRIOR ART)
FIG. 6 is a top view of the conventional fly shield of FIG. 2 during another step of constructing the conventional fly shield.
Figure 7:
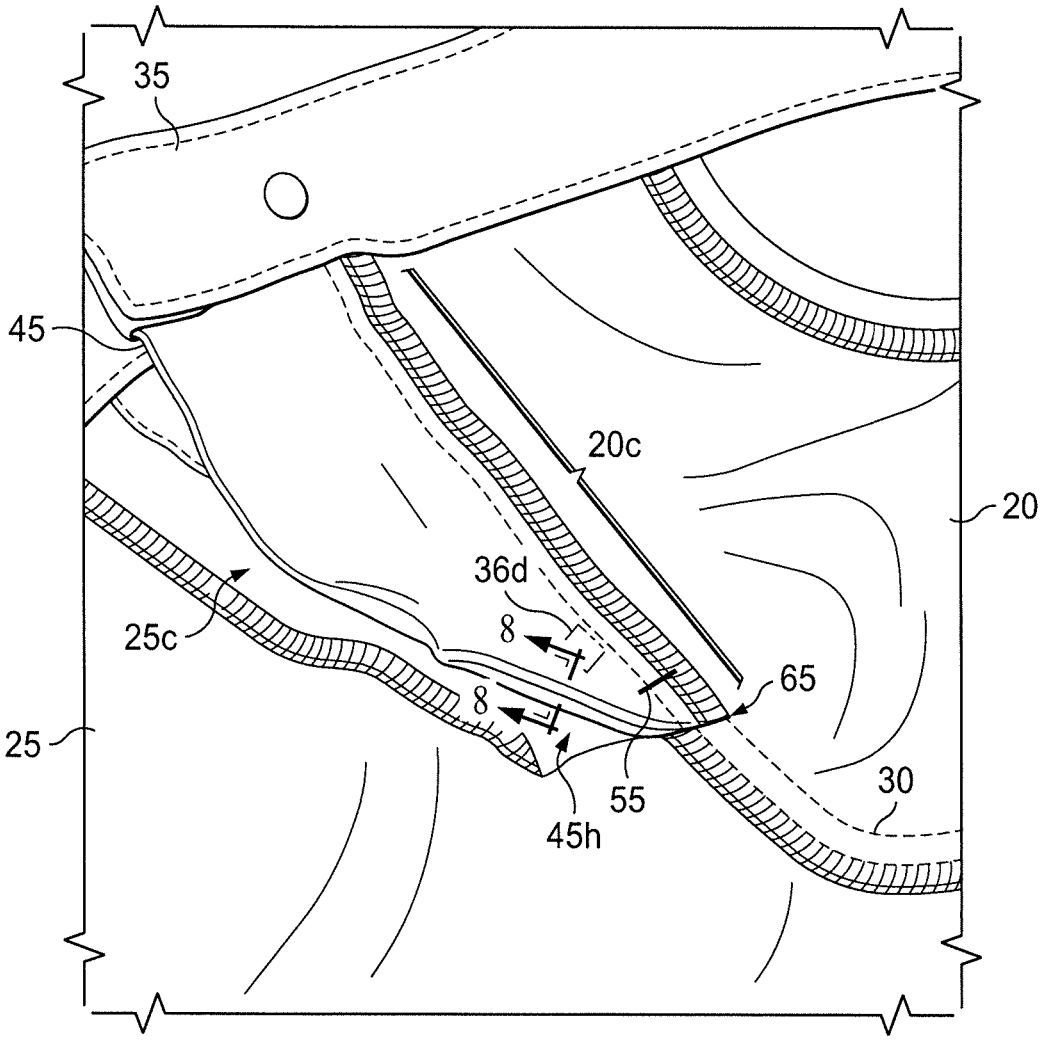
Fig. 7 (PRIOR ART)
FIG. 7 is another perspective view of the front portion, including the conventional fly shield, of FIG. 2.
Figure 8:
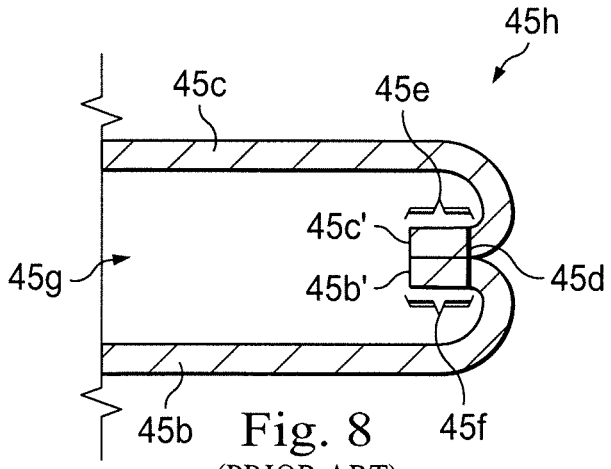
Fig. 8 (PRIOR ART)
FIG. 8 is a cross-sectional view of a portion of the conventional fly shield of FIG. 7, the cross-sectional view being taken along line 8-8 of FIG. 7.

As illustrated in FIGS. 1 and 2, a garment 10 includes a conventional front portion 15. The garment 10 may be, for example, a pair of pants, a pair of shorts, a skirt, or a pair of jeans as shown in FIGS. 1 and 2. The front portion 15 is generally formed from right (from the wearer's perspective) panel 20 and a left panel 25. The right and left panels 20 and 25 are coupled together in part via a crotch seam 30, a clasp 33 on a waistband 35, and a zipper 36 (shown in FIG. 3) that is positioned under/behind a fly 40. Specifically, a first side portion 20*a* of the right panel 20 is coupled to a first side portion 25*a* of the left panel 25 via the crotch seam 30. An upper portion 20*b* of the right panel 20 is stitched to the waistband 35 and an upper portion 25*b* of the left panel 25 is stitched to the waistband 35. As illustrated in FIG. 2, a fly shield 45 is coupled to the waistband 35, to the right panel 20 via a seam 50, to the crotch seam via the seam 50 and a bartack 55, and to the left panel 25 via an anchor stitch 60. The crotch seam 30 extends upwards towards the waistband 35 until it terminates at the bartack 55. Generally, a bartack is a series of stitches used to reinforce an area of a garment. Thus, the bartack 55 is stitched over the crotch seam 30, or at least one end of the crotch seam 30. Generally, and referring to FIGS. 3 and 4, the zipper 36 includes a first strip of teeth 36*a*, a second strip of teeth 36*b*, a slider 36*c* that couples and decouples the strips of teeth 36*a* and 36*b*, and a zipper stop 36*d* that stops the movement of the slider 36*c* relative to the strips of teeth 36*a* and 36*b*. A second side portion 20*c* of the right panel 20 is coupled to the zipper 36. As illustrated in FIG. 4, for the purpose of clarity, the anchor stitch 60 is not shown coupling the fly shield 45 to the left panel 25. Instead, for the purpose of clarity, the anchor stitch 60 is shown as severed, which results in a first portion 60*a* of the anchor stitch 60 extending through the fly shield 45 and a second portion 60*b* of the anchor stitch 60 extending through the left panel 25 (in reality, and in contrast to the illustration in FIG. 4, the anchor stitch 60 is not so severed, and thus the anchor stitch 60 extends through the fly shield 45 and the left panel 25, coupling the fly shield 45 to the left panel 25, as shown in FIGS. 1 and 3). A second side portion 25*c* of the left panel 25 is coupled to the zipper 36. Referring to FIG. 5, the fly shield 45 is conventionally constructed from a piece of material 45*a* that has a first portion 45*b* defining a first edge 45*b*' and a second portion 45*c* defining a second edge 45*c*'. As illustrated in FIG. 6, the material 45*a* is folded such that the first edge 45*b*' is substantially aligned with the second edge 45*c*' and the second portion 45*c* faces the first portion 45*b*. The first and second portions 45*b* and 45*c* are then coupled together via a stitch or seam 45*d* thereby defining a first and second seam allowance 45*e* and 45*f* (the second seam allowance 45*f* is shown in FIG. 8), of the second and first portions 45*c* and 45*b*, respectively. When folded and stitched together as illustrated in FIGS. 5 and 6, the material 45*a* is generally "inside-out" or the right-side of the material is facing itself. After stitching, the fly shield 45 is then turned "right-side out" thereby causing the first and second seam allowances 45*e* and 45*f* to be positioned within a pocket 45*g* (shown in FIG. 8) formed by the first and second portions 45*b* and 45*c* that form a bottom portion 45*h* of the fly shield 45. When the fly shield 45 is attached to the right panel 20 as illustrated in FIG. 7, the bottom portion 45*h*—including the first portion 45*b*, the first seam allowance 45*e*, the second seam allowance 45*f*, and the second portion 45*c*—are attached to the crotch seam 30 at a location 65, thereby adding four (4) layers of material to the thickness of the front portion 15 at the crotch seam 30, which is already at least two layers thick (the front panel 20 and left panel 25). As such, the bottom portion 45*h* of the fly shield 45 creates a bumpy front portion 15 when the garment 10 is worn by a user. Moreover, the spandex breakage on high stretch fabrics is increased due to the positioning of the fly shield seam 45*d* relative to the crotch seam 30 and/or the bulkiness of the bottom portion 45*h* of the fly shield 45. Moreover, the fly shield seam 45*d* is stitched to the front portion 15 at the location 65, with the zipper stop 36*d* and the bartack 55 being positioned between the waistband 35 and the location 65.

Figure 9:
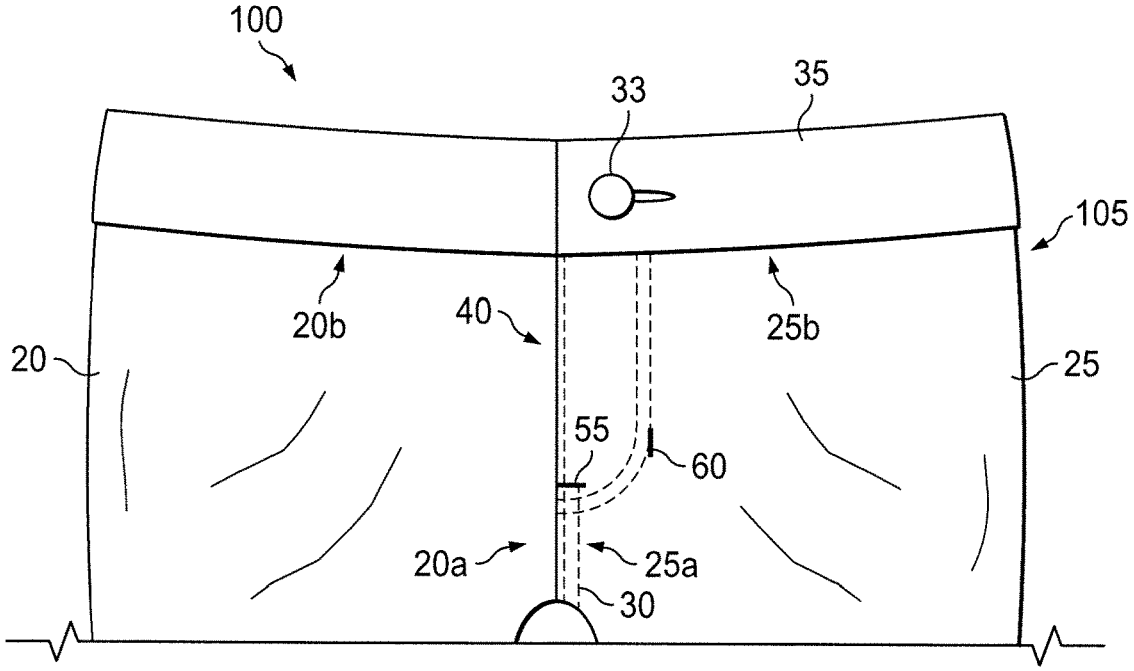
FIG. 9 is a front view of a front portion of a garment including a fly shield, according to an example embodiment.
Figure 10:
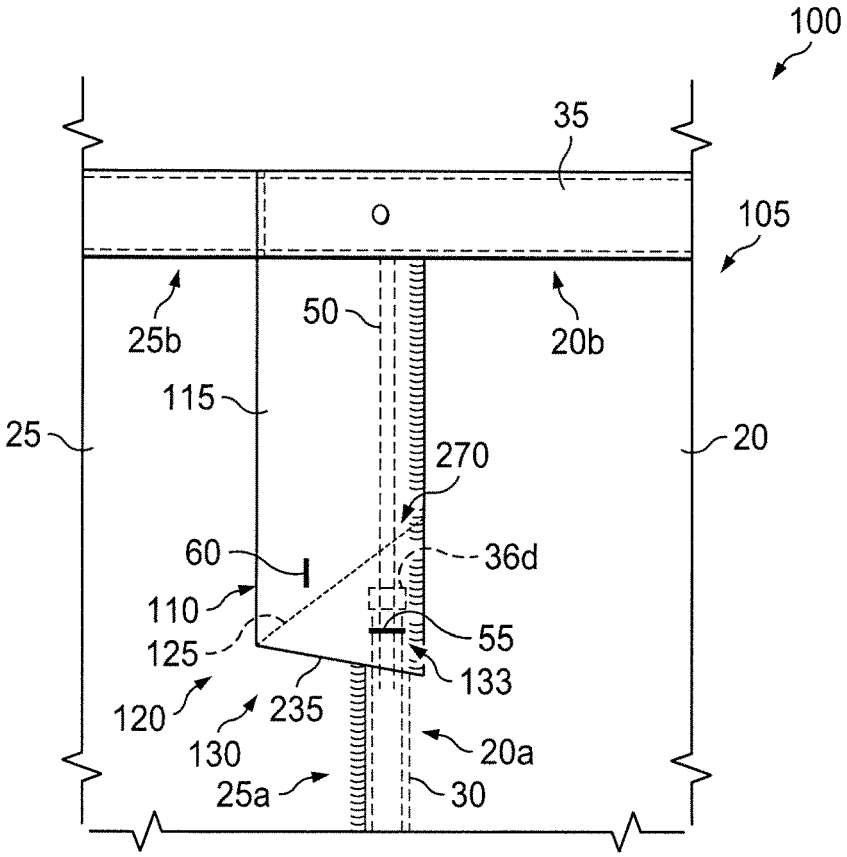
FIG. 10 is a back view of the front portion, including the fly shield, of the garment of FIG. 9, according to an example embodiment.

In an example embodiment, as illustrated in FIGS. 9 and 10, a garment 100 includes a front portion 105. The front portion 105 is generally identical or substantially similar to the front portion 15 except that the conventional fly shield 45 is replaced with a fly shield 110 formed from a material 115. In FIG. 10, the seam 125 is facing towards the left panel 25 and hidden from view, but shown with a dotted line to illustrate the position of the seam 125 relative to other portions of the garment 100, such as the bartack 55, the waistband 35, the zipper stop 36*d*, and the crotch seam 30.

Figure 11:
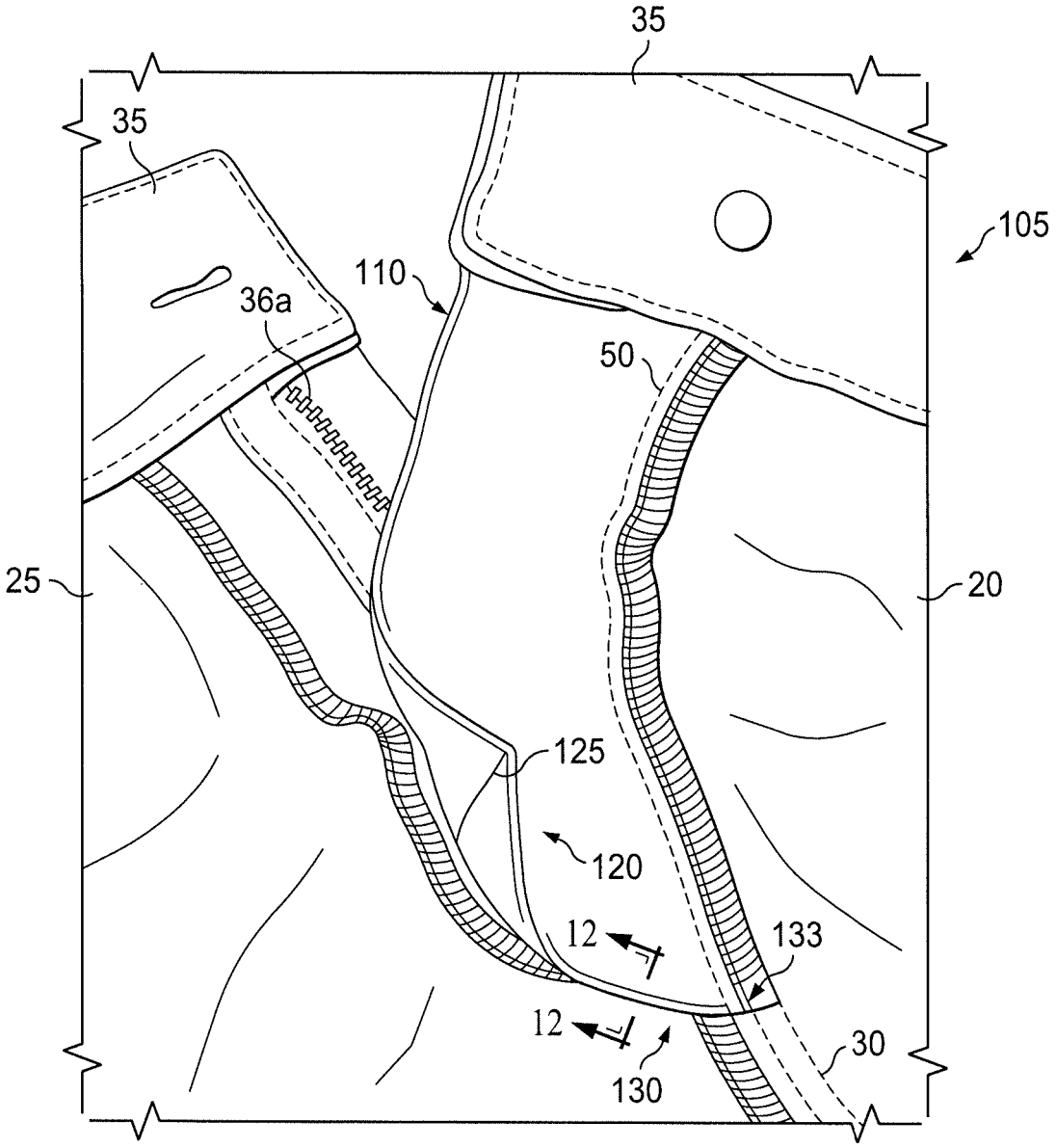
FIG. 11 is another perspective view of the front portion, including the fly shield, of the garment of FIG. 9, according to an example embodiment.
Figure 12:
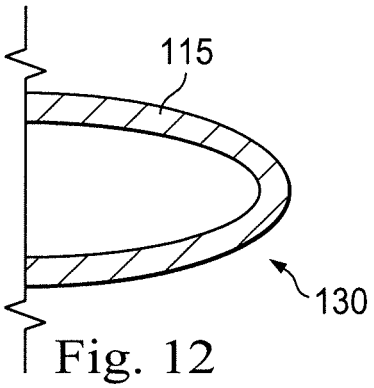
FIG. 12 is a cross-sectional view of a portion of the fly shield of FIG. 11, according to an example embodiment, the cross-sectional view being taken along line 12-12 of FIG. 11.

As illustrated in FIGS. 10, 11, and 12, in an example embodiment, the fly shield 110 is formed by the material 115 being folded and stitched to form a mitered corner 120 defined by a fly shield seam 125 such that a bottom portion 130 of the fly shield 110 is formed from a fold of the material 115 (illustrated in FIG. 12). Moreover, the seam 125 faces away from the user when the user is wearing the garment 100. The facing of the seam 125 away from the user prevents or reduces agitation or friction between the seam 125 and the user. As illustrated in FIG. 12, the bottom portion 130 includes only a first layer of the material 115 and a second layer of the material 115. When attached to the crotch seam 30 at a location 133, the fly shield 110 significantly reduces spandex breakage on high stretch fabrics, creating a more clean and smooth look across the fly area due to the placement of the fly shield seam 125 relative to the front portion 105. In an example embodiment, the fly shield 110 reduces the layers of material (2 layers) in the bottom portion 130 of the fly shield 110, as compared to the layers of material (4 layers) in the portion of the conventional fly shield 45 that extends over the crotch seam 30.

Figure 13:
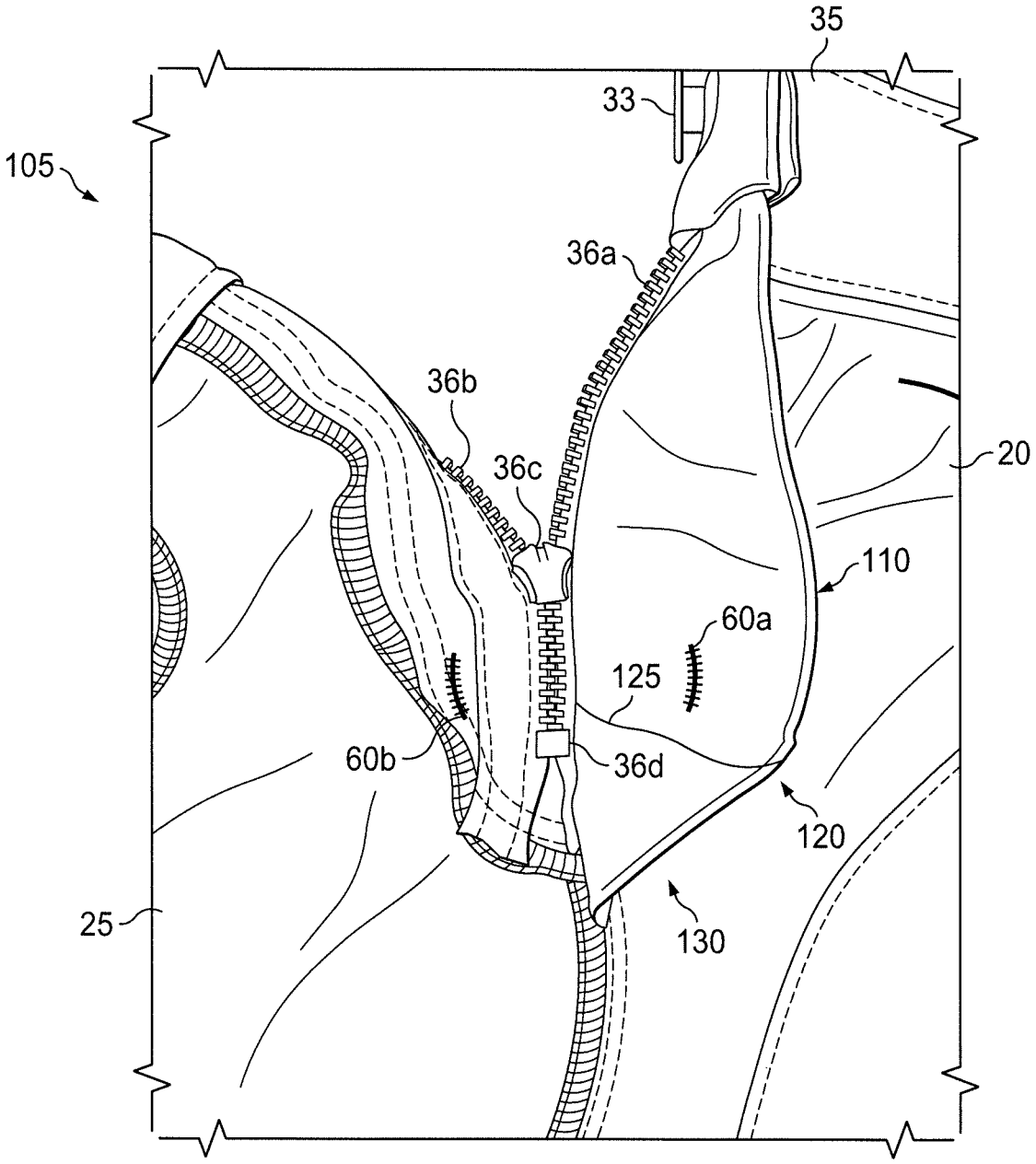
FIG. 13 is another perspective view of the front portion of FIG. 11, according to an example embodiment.

As illustrated in FIG. 13, for the purpose of clarity, the anchor stitch 60 is not shown coupling the fly shield 110 to the left panel 25. Instead, for the purpose of clarity, the anchor stitch 60 is shown as severed, which results in the first portion 60*a* of the anchor stitch 60 extending through the fly shield 110 and the second portion 60*b* of the anchor stitch 60 extending through the left panel 25 (in reality, and in contrast to the illustration in FIG. 13, the anchor stitch 60 is not so severed, and thus the anchor stitch 60 extends through the fly shield 110 and the left panel 25, coupling the fly shield 110 to the left panel 25, as shown in FIGS. 9 and 10). As shown in FIG. 13, in an example embodiment, at least a portion of the fly shield seam 125 extends above the zipper stop 36*d*, and the fly shield seam 125 is stitched to the right panel 20 at a location between the zipper stop 36*d* and the waistband 35.

Figure 14:
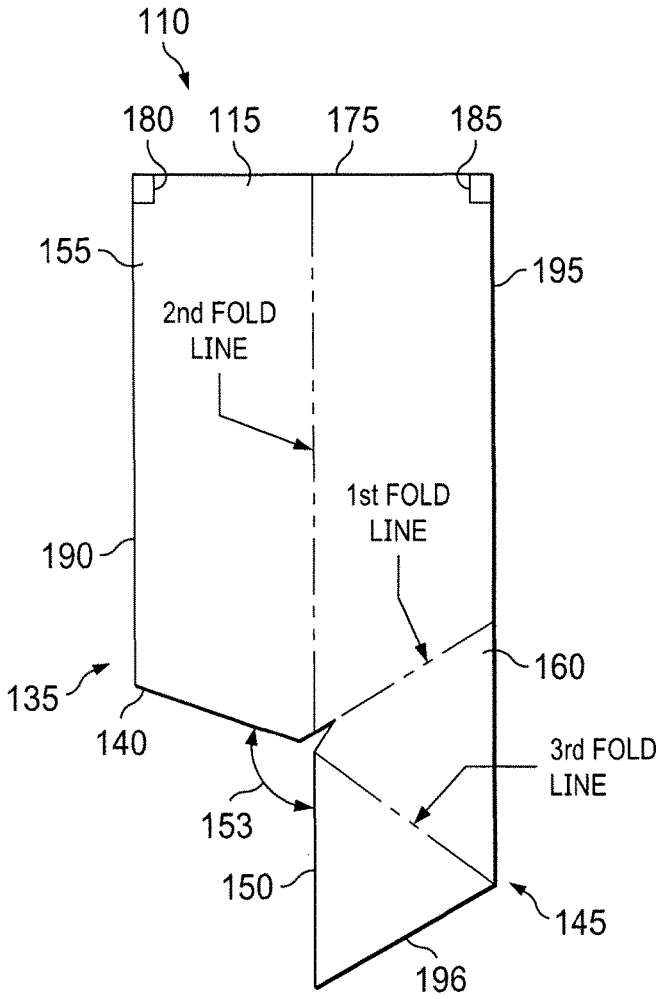
FIG. 14 is a top plan view of the fly shield of FIG. 10 during construction of the fly shield, according to an example embodiment.
Figure 15:
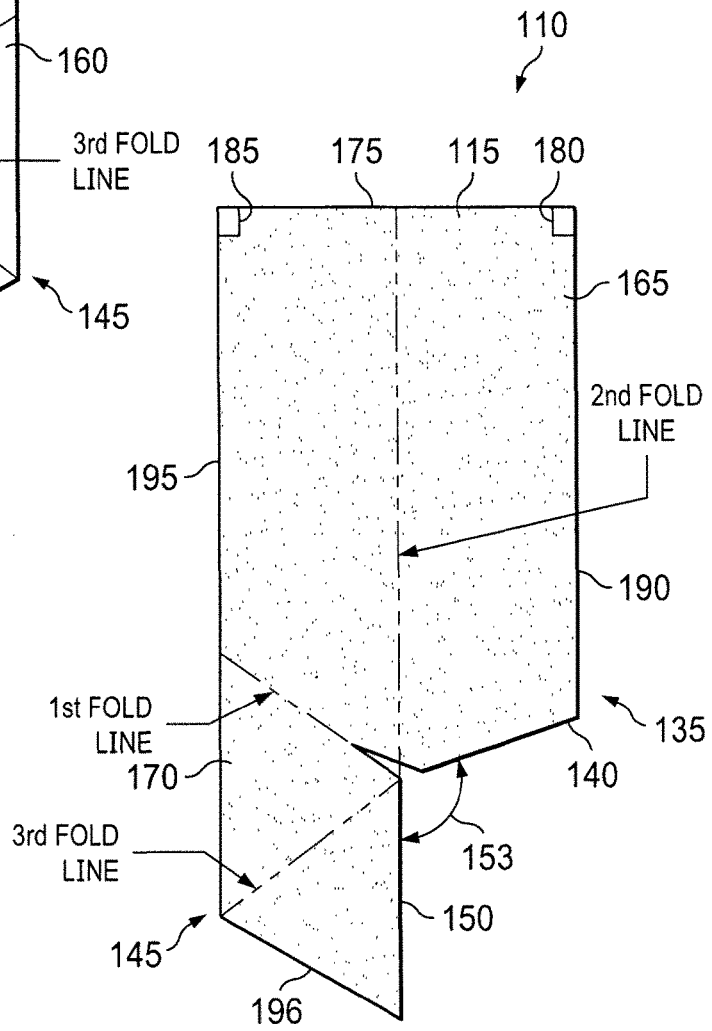
FIG. 15 is a bottom plan view of the fly shield of FIG. 14, according to an example embodiment.

In an example embodiment, a top plan view of the material 115 is illustrated in FIG. 14. The material 115 includes a first portion 135 including a first edge 140 and a second portion 145 including a second edge 150, wherein an obtuse angle 153 is defined between the first edge 140 and the second edge 150. A first fold line is depicted in the second portion 145, a second fold line is depicted as generally dividing the first and second portions 135 and 145, and a third fold line is depicted in the second portion 145. The first portion 135 has a surface 155 and the second portion has a surface 160. A bottom plan view of the material 115 is illustrated in FIG. 15, with the first portion 135 having a surface 165 and the second portion 145 having a surface 170. Generally, the contiguous surfaces 155 and 160 are the "right" surfaces, and the contiguous surfaces 165 and 170 are the "wrong" surfaces, such that the surfaces 165 and 170 are normally placed in a less visible portion of the garment 100 while the surfaces 155 and 160 are generally outwardly facing surfaces or more visible surfaces.

As illustrated in FIGS. 14 and 15, in an example embodiment, the material 115 has an upper edge 175 that extends between two corners defining angles 180 and 185, respectively, the angles 180 and 185 being 90-degree angles approximately (+/−5 degrees). The material 115 also has an edge 190 and an opposing edge 195. The edge 190 extends between the edges 175 and 140. The edge 195 extends between the edge 175 and a bottom edge 196, which is adjacent to the edge 150.

Figure 16:
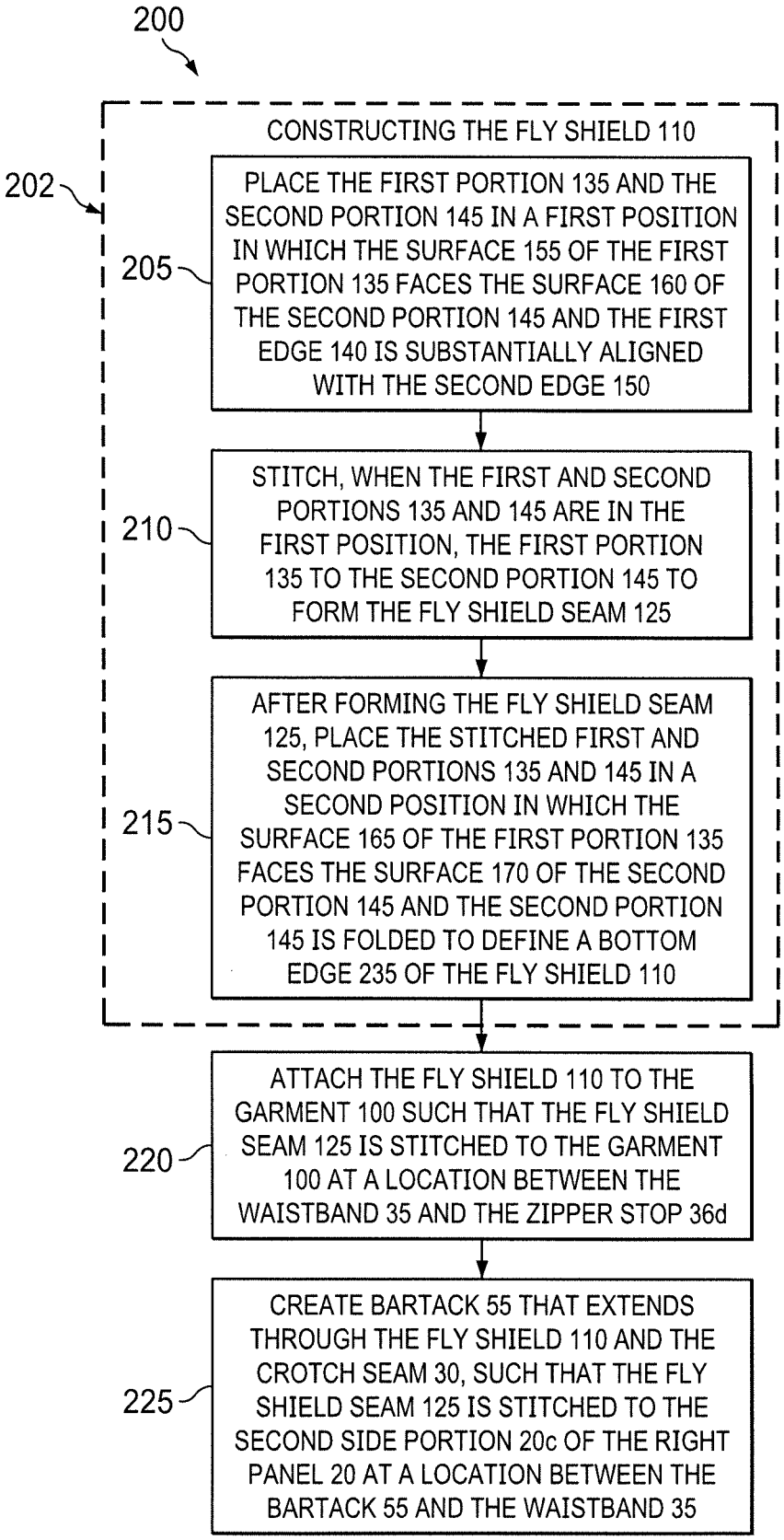
FIG. 16 is a flow chart illustration of a method of constructing the fly shield of FIG. 10, according to example embodiment.

In an example embodiment, as illustrated in FIG. 16 with continuing reference to FIGS. 9-15, a method 200 includes: constructing the fly shield 110 using the material 115 at step 202, which includes placing the first portion 135 and the second portion 145 in a first position in which the surface 155 of the first portion 135 faces the surface 160 of the second portion 145 and the first edge 140 is substantially aligned with the second edge 150 at step 205; stitching, when the first and second portions 135 and 145 are in the first position, the first portion 135 to the second portion 145 to form the fly shield seam 125 at step 210; and after forming the fly shield seam 125, placing the stitched first and second portions 135 and 145 in a second position in which the surface 165 of the first portion 135 faces the surface 170 of the second portion 145 and the second portion 145 is folded to define a bottom edge of the fly shield at step 215. In an example embodiment, the method 200 further includes: attaching the fly shield 110 to the garment 100 such that the fly shield seam 125 is stitched to the garment 100 at a location between the waistband 35 and the zipper stop 36*d* at step 220; and creating the bartack 55 that extends through the fly shield 110 and the crotch seam 30 such that the fly shield seam 125 is stitched to the second side portion 20*c* of the right panel 20 at a location between the bartack 55 and the waistband 35.

Figure 17:
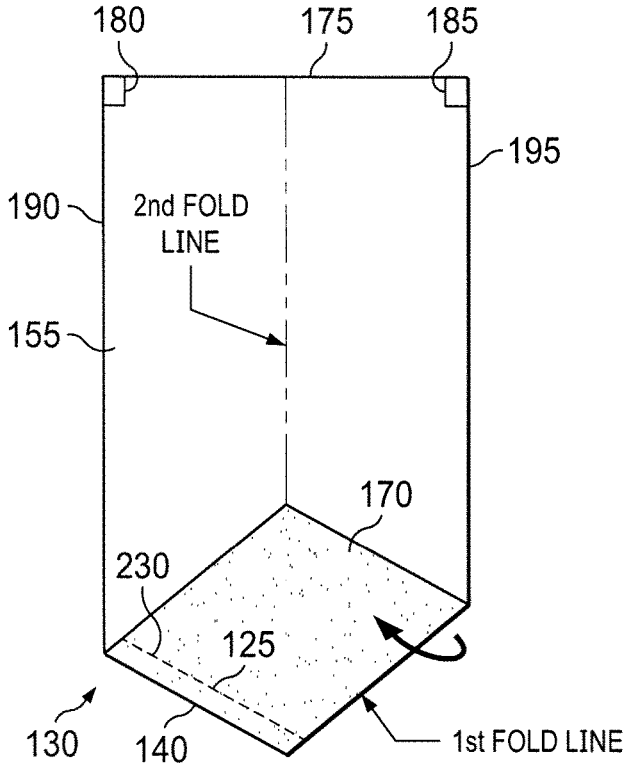
FIG. 17 is a top view of the fly shield of FIG. 10 during the execution of a step of the method of FIG. 16, according to an example embodiment.

At the step 205, the first portion 135 and the second portion 145 are placed in a first position in which the surface 155 of the first portion 135 faces the surface 160 of the second portion 145 and the first edge 140 is substantially aligned with the second edge 150. As illustrated in FIG. 17, a portion of the second portion 145 has been folded along the first fold line such that the edges 140 and 150 are substantially aligned and so that the surfaces 155 and 160 face each other.

At the step 210, the first portion 135 and the second portion 145 are stitched together via stitching 230 to form the fly shield seam 125 when the first and second portions 135 and 145 are in the first position. The stitching of the first portion 135 to the second portion 145 forms a pocket that is "inside-out." As illustrated in FIG. 17, the bottom edges of the pocket include the seam 125 and the material 115 folded along the first fold line. In this position, the "wrong" side of the material is outwardly facing. While FIG. 17 illustrates the pocket collapsed, or flattened, against the remainder of the material 115, the pocket can form a 3-D cone-shaped cup.

At the step 215, the stitched first and second portions 135 and 145 are placed in the second position in which the surface 165 of the first portion 135 faces and is in contact with, or at least faces, the surface 170 of the second portion 145, and the second portion 145 is folded to define a bottom edge 235 of the fly shield 110. To move from the first position to the second position, the pocket is flipped from the inside-out position to a right-side out position. The pocket forms a 3-D cone-shaped cup in this right-side out position. After forming the 3-D cone-shaped cup, the edges 190 and 195 are aligned, with the surface 165 facing the surface 170, and the fly shield 110 is flattened such that the material 115 is folded along the second fold line. When the 3-D cone is flattened, the material 115 forming the pocket or cup is forced to fold as well, and folds along the third fold line. The material 115 is folded along the second fold line before, simultaneously with, or after the material 115 is folded along the third fold line.

Figure 18:
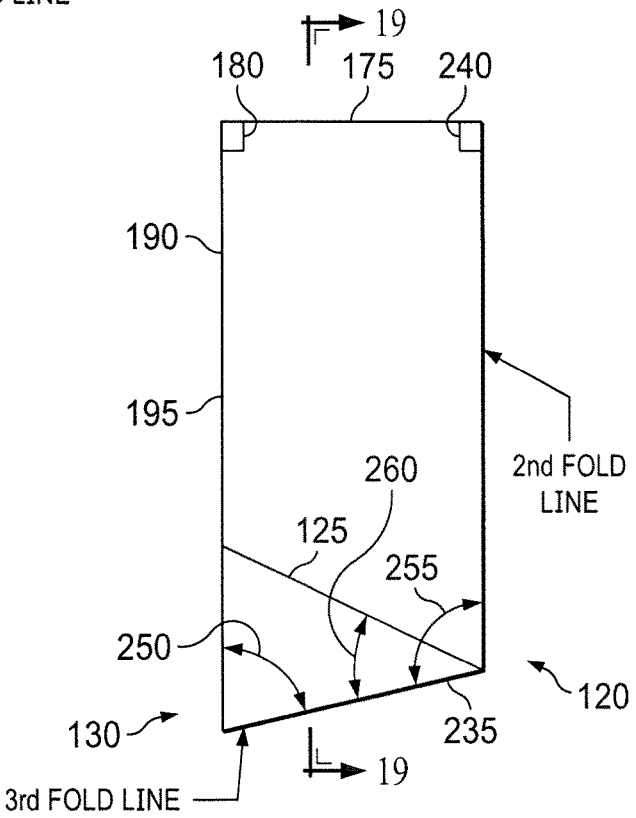
FIG. 18 is a top view of the fly shield of FIG. 10 during the execution of another step of the method of FIG. 16, according to an example embodiment.
Figure 19:
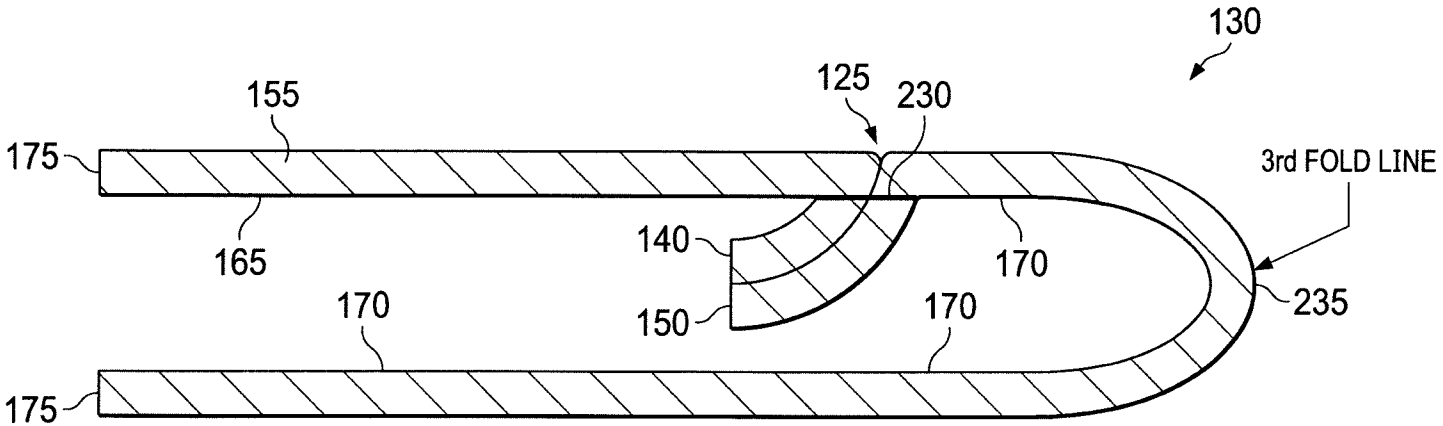
FIG. 19 is a cross-sectional view of the fly shield of FIG. 18, according to an example embodiment, the cross-sectional view being taken along line 19-19 of FIG. 18.

FIGS. 18 and 19 illustrate the fly shield 110 when in the second position. When in the second position, the fly shield seam 125 forms the mitered corner 120. In an example embodiment, the mitered corner 120 is defined by the fly shield seam 125. Moreover, when in the second position, the fly shield 110 has an approximate trapezoid shape defining two approximate right angles (angle 180 and opposing angle 240), a first acute angle 250, and an obtuse angle 255. Generally, the fly shield seam 125 extends towards a vertex of the obtuse angle 255, and the fly shield 110 defines the bottom folded edge 235 that extends between the vertex of the obtuse angle 255 and a vertex of the first acute angle 250. In an example embodiment, the fly shield seam 125 and the bottom folded edge 235 intersect to form a second acute angle 260, which is a portion of the obtuse angle 255. In an example embodiment and due to the fly shield seam 125 being angled relative to the bottom edge 235, at least a portion of the fly shield seam 125 is spaced from the bottom edge 235 between about 1 inch and 2 inches, between about 1.1 inches and 1.9 inches, between about 1.3 inches and about 1.7 inches, between about 1.4 inches and about 1.6 inches, or by approximately 1.5 inches. In some example embodiments, the spacing is greater than 1.9 inches but less than 3 inches and can be smaller than 1 inch but greater than 0.25 inches. In an example embodiment and referring back to FIG. 10, the bottom folded edge 235 forms the bottom portion 130 of the fly shield 110, and the only portion of the fly shield 110 that is configured to extend over the crotch seam 30 of the garment 100 (when the fly shield 110 is attached to the garment 100) is the bottom portion 130. Thus, the fly shield seam 125 is spaced from the crotch seam 30 such that the fly shield seam 125 attaches to only the right panel 20 (not both left and right panels 20 and 25). In an example embodiment, the bottom portion 130 of the fly shield 110 consists of a first material layer and a second material layer as illustrated in FIGS. 12 and 19. Although the surface 165 as shown in FIG. 19 is only facing the surface 170, in several embodiments the surface 165 faces and is in contact with the surface 170.

At the step 220 and referring back to FIG. 10, the fly shield 110 is attached to the garment 100 via the seam 50 such that the fly shield seam 125 is stitched to the garment 100 at a location 270 between the waistband 35 and the zipper stop 36*d*. Moreover, the surface facing the user (when the garment 100 is worn by the user) is a smooth or clean finished surface due to the seam 125 facing away from the user and towards the zipper 36.

At the step 225, the bartack 55 is added to the garment 100. In one embodiment, the fly shield seam 125 is stitched to the second side portion 20*c* of the right panel 20 at the location 270 that is between the bartack 55 and the waistband 35.

In several example embodiments, the placement of the fly shield seam 125 relative to the fly shield 110 and/or the crotch seam 30 reduces abrasion and "drag" as the seam 125 goes under a sewing foot during construction of the garment 100. Moreover, the reduction of material layers (from 4 in a conventional fly shield to 2 in the fly shield 110) in the bottom portion 130 reduces the bumpiness or bulge created in the fly area when the garment 100 is worn by the user. Additionally, the seam 125 facing outwardly towards the zipper 36 instead of facing inwardly toward the user reduces agitation and/or friction between the seam 125 and the user.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

An example embodiment of a garment has been described that includes a first front panel; a second front panel; wherein a first side portion of the first front panel is coupled to a first side portion of the second front panel via a crotch seam; a waistband coupled to an upper portion of the first front panel and an upper portion of the second front panel; a zipper coupled to a second side portion of the first front panel and a second side portion of the second front panel; and a fly shield including a material folded and stitched to form a mitered corner defined by a fly shield seam, wherein the fly shield defines a bottom folded edge; wherein the bottom folded edge forms a bottom portion of the fly shield; wherein the only portion of the fly shield that extends over the crotch seam is the bottom portion; and wherein the bottom portion of the fly shield consists of a first material layer and a second material layer. In an example embodiment, the zipper includes a zipper stop; and wherein the fly shield seam is stitched to the second side portion of the first front panel at a location between the zipper stop and the waistband. In an example embodiment, the garment is a pair of pants or a pair of shorts. In an example embodiment, the fly shield has an approximate trapezoid shape defining two approximate right angles, a first acute angle, and an obtuse angle; wherein the fly shield seam of the mitered corner extends towards a vertex of the obtuse angle; and wherein the bottom folded edge extends between the vertex of the obtuse angle and a vertex of the first acute angle. In an example embodiment, the fly shield seam and the bottom folded edge intersect to form a second acute angle, which is a portion of the obtuse angle. In an example embodiment, the fly shield seam is spaced from the crotch seam. In an example embodiment, the garment further includes a bartack formed through a portion of the fly shield and the crotch seam; and wherein the fly shield seam is stitched to the second side portion of the first front panel at a location between the bartack and the waistband.

An example embodiment of a garment has been described that includes a first front panel; a second front panel; wherein a first side portion of the first front panel is coupled to a first side portion of the second front panel via a crotch seam; a waistband coupled to an upper portion of the first front panel and an upper portion of the second front panel; a zipper coupled to a second side portion of the first front panel and a second side portion of the second front panel; and a fly shield including a material folded and stitched to form a mitered corner defined by a fly shield seam, wherein the fly shield is stitched to the second side portion of the first front panel. In an example embodiment, the zipper includes a zipper stop; and wherein the fly shield seam is stitched to the second side portion of the first front panel at a location between the zipper stop and the waistband. In an example embodiment, the garment is a pair of pants or a pair of shorts. In an example embodiment, the fly shield has an approximate trapezoid shape defining two approximate right angles, a first acute angle, and an obtuse angle; wherein the fly shield seam of the mitered corner extends towards a vertex of the obtuse angle; and wherein the fly shield defines a bottom folded edge that extends between the vertex of the obtuse angle and a vertex of the first acute angle. In an example embodiment, the fly shield seam and the bottom folded edge intersect to form a second acute angle, which is a portion of the obtuse angle. In an example embodiment, the bottom folded edge forms a bottom portion of the fly shield; and wherein the only portion of the fly shield that extends over the crotch seam is the bottom portion. In an example embodiment, the bottom portion of the fly shield consists of a first material layer and a second material layer. In an example embodiment, the fly shield seam is spaced from the crotch seam. In an example embodiment, the garment also includes a bartack formed through a portion of the fly shield and the crotch seam; and wherein the fly shield seam is stitched to the second side portion of the first front panel at a location between the bartack and the waistband.

An example embodiment of a fly shield for a garment has been described, the fly shield including a material folded and stitched to form a mitered corner. In an example embodiment, the mitered corner is defined by a fly shield seam; wherein the fly shield has an approximate trapezoid shape defining two approximate right angles, a first acute angle, and an obtuse angle; wherein the fly shield seam extends towards a vertex of the obtuse angle; and wherein the fly shield defines a bottom folded edge that extends between the vertex of the obtuse angle and a vertex of the first acute angle. In an example embodiment, the fly shield seam and the bottom folded edge intersect to form a second acute angle, which is a portion of the obtuse angle. In an example embodiment, the bottom folded edge forms a bottom portion of the fly shield; and wherein the only portion of the fly shield that is configured to extend over a crotch seam of a garment is the bottom portion. In an example embodiment, the bottom portion of the fly shield consists of a first material layer and a second material layer.

An example embodiment of a method has been described, the method including constructing a fly shield using a material, wherein the material includes a first portion including a first edge and a second portion including a second edge, wherein an obtuse angle is defined between the first edge and the second edge, wherein the first portion has a first surface and an opposing second surface; and wherein the second portion has a third surface and an opposing fourth surface; wherein constructing the fly shield using the material includes: placing the first portion and the second portion in a first position in which the first surface of the first portion faces the third surface of the second portion and the first edge is substantially aligned with the second edge; stitching, when the first and second portions are in the first position, the first portion to the second portion to form a fly shield seam; and after forming the fly shield seam, placing the stitched first and second portions in a second position in which the second surface of the first portion faces the fourth surface of the second portion and the second portion is folded to define a bottom edge of the fly shield. In an example embodiment, the method also includes attaching the fly shield to a garment that includes a waistband and a zipper stop such that the fly shield seam is stitched to the garment at a location between the waistband and the zipper stop. In an example embodiment, the garment is a pair of pants or a pair of shorts. In an example embodiment, the method also includes stitching the fly shield seam to a front portion of a garment; and creating a bartack that extends through the fly shield and a crotch seam of the garment; wherein the garment includes a waistband; and the fly shield seam is stitched to the front portion of the garment at a location that is between the waistband and the bartack. In an example embodiment, the method also includes attaching the fly shield to a garment that includes a crotch seam; wherein the bottom edge forms a bottom portion of the fly shield; and wherein the only portion of the fly shield that extends over the crotch seam is the bottom portion. In an example embodiment, the bottom portion of the fly shield consists of a first material layer and a second material layer. In an example embodiment, the fly shield seam is spaced from the crotched seam. In an example embodiment, a mitered corner is formed by the fly shield seam when the stitched first and second portions are in the second position; and wherein, when the stitched first and second portions are in the second position: the fly shield has an approximate trapezoid shape defining two approximate right angles, a first acute angle, and an obtuse angle; the fly shield seam of the mitered corner extends towards a vertex of the obtuse angle; and the bottom edge extends between the vertex of the obtuse angle and a vertex of the first acute angle. In an example embodiment, the fly shield seam and the bottom folded edge intersect to form a second acute angle, which is a portion of the obtuse angle.

A garment has been described that includes a first front panel; a second front panel; wherein a first side portion of the first front panel is coupled to a first side portion of the second front panel via a crotch seam; a waistband coupled to an upper portion of the first front panel and an upper portion of the second front panel; a zipper coupled to a second side portion of the first front panel and a second side portion of the second front panel; a fly shield including a material folded and stitched to form a mitered corner defined by a fly shield seam, wherein the fly shield is stitched to the second side portion of the first front panel; and a bartack formed through a portion of the fly shield and the crotch seam; wherein the fly shield seam is stitched to the second side portion of the first front panel at a location between the bartack and the waistband. In an example embodiment, the garment is a pair of pants or a pair of shorts. In an example embodiment, the fly shield has an approximate trapezoid shape defining two approximate right angles, a first acute angle, and an obtuse angle; wherein the fly shield seam of the mitered corner extends towards a vertex of the obtuse angle; and wherein the fly shield defines a bottom folded edge that extends between the vertex of the obtuse angle and a vertex of the first acute angle. In an example embodiment, the fly shield seam and the bottom folded edge intersect to form a second acute angle, which is a portion of the obtuse angle. In an example embodiment, the bottom folded edge forms a bottom portion of the fly shield; and wherein the only portion of the fly shield that extends over the crotch seam is the bottom portion. In an example embodiment, the bottom portion of the fly shield consists of a first material layer and a second material layer. In an example embodiment, the fly shield seam is spaced from the crotched seam.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are examples only and are not limiting, and those skilled in the art will readily appreciate that many other modifications, changes, and/or substitutions are possible in the example embodiments without materially departing from the novel teachings and advantages of the present disclosure. Accordingly, all such modifications, changes, and/or substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A garment, comprising:
a first front panel;
a second front panel;
wherein a first side portion of the first front panel is coupled to a first side portion of the second front panel via a crotch seam;
a waistband coupled to an upper portion of the first front panel and an upper portion of the second front panel;
a zipper coupled to a second side portion of the first front panel and a second side portion of the second front panel;
wherein the zipper is positioned between the waistband and the crotch seam;
and
a fly shield coupled to the waistband and extending along a length of the zipper and over the crotch seam;
wherein a first portion of the fly shield extends over the crotch seam;
wherein the fly shield comprises a material folded over itself to form a first material layer and a second material layer; and
wherein the first portion of the fly shield consists of the first material layer and the second material layer.

2. The garment of claim 1,
wherein the zipper comprises a zipper stop;
wherein a second portion of the fly shield extends between the zipper stop and the crotch seam; and
wherein the second portion of the fly shield consists of the first material layer and the second material layer.

3. The garment of claim 1, wherein the garment is a pair of pants or a pair of shorts.

4. The garment of claim 1,
wherein a fold distinguishes the first material layer from the second material layer;
wherein the fly shield has an approximate trapezoid shape defining two approximate right angles, an acute angle, and an obtuse angle; and
wherein the fold extends between a vertex of the obtuse angle and a vertex of the acute angle.

5. The garment of claim 4, further comprising a bartack formed through the fly shield and the crotch seam;
wherein a third portion of the fly shield extends between the bartack and the fold; and
wherein the third portion consists of the first material layer and the second material layer.

6. A garment comprising:
a first front panel;
a second front panel;
wherein a first side portion of the first front panel is coupled to a first side portion of the second front panel via a crotch seam;
a waistband coupled to an upper portion of the first front panel and an upper portion of the second front panel;
a zipper coupled to a second side portion of the first front panel and a second side portion of the second front panel;
wherein the zipper is positioned between the waistband and the crotch seam;
and
a fly shield coupled to the waistband and extending along a length of the zipper and over the crotch seam;
wherein a first portion of the fly shield extends over the crotch seam; and
wherein the first portion of the fly shield has less than four layers of material.

7. The garment of claim 6,
wherein the zipper comprises a zipper stop;
wherein a second portion of the fly shield extends between the zipper stop and the crotch seam; and
wherein the second portion of the fly shield has less than four layers of material.

8. The garment of claim 6, wherein the garment is a pair of pants or a pair of shorts.

9. The garment of claim 6,
wherein the fly shield comprises a material folded over itself to form a fold that distinguishes a first layer of the material from a second layer of the material; and
wherein the first portion of the fly shield consists of the first layer of material and the second layer of material.

10. The garment of claim 9, wherein the fly shield has an approximate trapezoid shape defining two approximate right angles, an acute angle, and an obtuse angle; and wherein the fold extends between a vertex of the obtuse angle and a vertex of the acute angle.

11. The garment of claim 6, further comprising a bartack formed through the fly shield and the crotch seam;
wherein a third portion of the fly shield extends between the bartack and the crotch seam; and
wherein the third portion of the fly shield has less than four layers of material.

12. A fly shield for a garment, the fly shield comprising a material folded to create a first fold and a second fold;

wherein the fly shield has an approximate trapezoid shape defining two approximate right angles, an acute angle, and an obtuse angle;

wherein the first fold extends between the obtuse angle and one of the two approximate right angles;

wherein the second fold extends between the obtuse angle and the acute angle;

wherein a first portion of the fly shield that includes the second fold consists of a first material layer and a second material layer;

wherein the fly shield is configured to be coupled to a waistband of a garment and extend along a length of a zipper and over a crotch seam of the garment; and wherein the first portion of the fly shield is configured to extend over the crotch seam.

13. A method of attaching the fly shield of claim 12 to the garment, wherein the garment comprises:

a first front panel;

a second front panel;

wherein a first side portion of the first front panel is coupled to a first side portion of the second front panel via the crotch seam;

the waistband coupled to an upper portion of the first front panel and an upper portion of the second front panel;

the zipper coupled to a second side portion of the first front panel and a second side portion of the second front panel;

wherein the zipper is positioned between the waistband and the crotch seam;

wherein the method comprises:

positioning the fly shield against the waistband of the garment, along a length of the zipper, and over the crotch seam of the garment;

stitching a second portion of the fly shield that forms the two approximate right angles to the waistband; and stitching a third portion of the fly shield that extends between one of the two approximate right angles and the acute angle to the second side portion of the first front panel such that the first portion of the fly shield extends over the crotch seam of the garment.

14. The method of claim 13, wherein the garment is a pair of pants or a pair of shorts.

15. The method of claim 13, further comprising:

creating a bartack that extends through the fly shield and the crotch seam of the garment;

wherein a fourth portion of the fly shield extends between the bartack and the second fold; and wherein the fourth portion of the fly shield consists of less than four layers of material.

16. The method of claim 13, further comprising:

creating a bartack that extends through the fly shield and the crotch seam of the garment;

wherein a fourth portion of the fly shield extends between the bartack and the second fold; and wherein the fourth portion of the fly shield consists of the first material layer and the second material layer.

17. The method of claim 13, wherein the zipper comprises a zipper stop;

wherein a fifth portion of the fly shield extends between the zipper stop and the second fold; and wherein the fifth portion of the fly shield consists of the first material layer and the second material layer.

18. The method of claim 13, wherein the zipper comprises a zipper stop;

wherein a fifth portion of the fly shield extends between the zipper stop and the second fold; and wherein the fifth portion of the fly shield has less than four layers of material.

19. The method of claim 13, further comprising:

creating a bartack that extends through the fly shield and the crotch seam of the garment;

wherein the zipper comprises a zipper stop;

wherein a sixth portion of the fly shield extends between the zipper stop and the bartack; and wherein the sixth portion of the fly shield consists of the first material layer and the second material layer.

20. The method of claim 13, creating a bartack that extends through the fly shield and the crotch seam of the garment;

wherein the zipper comprises a zipper stop;

wherein a sixth portion of the fly shield extends between the zipper stop and the bartack; and wherein the sixth portion of the fly shield has less than four layers of material.

* * * * *